US007717256B1

(12) United States Patent
Jensen

(10) Patent No.: US 7,717,256 B1
(45) Date of Patent: May 18, 2010

(54) SIDE-BY-SIDE LOCKING DISPLAY AND DISPENSING STRUCTURE

(75) Inventor: Craig A. Jensen, Van Meter, IA (US)

(73) Assignee: Owner Revolution Inc., Adair, IA (US)

( * ) Notice: Subject to any disclaimer, the term of this patent is extended or adjusted under 35 U.S.C. 154(b) by 553 days.

(21) Appl. No.: 11/784,140

(22) Filed: Apr. 5, 2007

(51) Int. Cl.
*A45C 11/18* (2006.01)
*B65D 21/02* (2006.01)

(52) U.S. Cl. ..... 206/39.3; 206/39; 206/229; 220/23.4

(58) Field of Classification Search ..... 206/39, 206/39.3, 39.7, 229, 504; 220/23.2, 23.4, 220/23.83
See application file for complete search history.

(56) References Cited

U.S. PATENT DOCUMENTS 224,486 A * 2/1880 Spruce ..... 220/23.4
5,287,980 A * 2/1994 Saltz ..... 220/4.27
5,492,398 A * 2/1996 Schafer ..... 206/394
5,542,571 A * 8/1996 Belka ..... 221/268
6,095,624 A * 8/2000 Wilbert ..... 312/34.7
2005/0173447 A1* 8/2005 Jensen ..... 221/45

* cited by examiner

*Primary Examiner*—J. Gregory Pickett
(74) *Attorney, Agent, or Firm*—G. Brian Pingel; Camille L. Urban

(57) ABSTRACT

A side-by-side locking display and dispensing structure formed by two ticket dispensing units having adjacent sidewalls and a coupling plate for demountably attaching said dispensing units together in a side-by-side relationship whereby the dispensing units have adjacent sidewalls that are connected together by the coupling plate. Also included in the dispensing units are rails for holding dividers that allow the units to hold tickets of different sizes and ticket fasteners that permit the tickets to be displayed at the front of the units.

10 Claims, 12 Drawing Sheets

SIDE-BY-SIDE LOCKING DISPLAY AND DISPENSING STRUCTURE

BACKGROUND OF THE INVENTION

1. Field of the Invention

The present invention relates in general to a structure that is formed of an assembly of molded lottery ticket dispensers secured together in a side-by-side relationship. More particularly, this invention relates to a coupling plate that serves as an intermediate member for demountably attaching two ticket dispensers together in a side-by-side relationship.

2. Description of the Prior Art

The use of modular box-like structures for displaying and dispensing of lottery tickets has long been known in the art. Normally, when a number of such dispensers are located together at a point of sale location, they are arranged in a stacked arrangement with one dispenser being stacked on top of another in a locked relationship as disclosed in U.S. Pat. No. 5,399,005 issued to Schafer on Mar. 21, 1995.

The stacking and locking features of the Schafer invention have proven to be highly popular and successful in utilization with modular ticket dispensing structures to form a stacked arrangement, but such invention is not applicable for fastening such dispensers in a side-by-side relationship so that two adjacent stacks of dispensers can be affixed to one another. Although the vast majority of lottery tickets utilized in the lottery industry have standard dimensions so that they can be dispensed from a wide variety of different types of ticket dispensers, occasionally a state lottery will conduct a game promotion that utilizes tickets of different sizes. To accommodate differently sized tickets, it is highly advantageous for a dispenser to be adjustable with respect to the number of ticket bins it may include. It is also advantageous for a typical lottery ticket dispenser that is formed from a transparent plastic to include display means by which a ticket sample of the particular type of game tickets in the dispenser is displayed for customers to be able to quickly ascertain the identity of the game tickets.

Thus, the present invention provides a locking display and dispensing structure comprised of at least two modular lottery ticket dispensers secured in a side-by-side relationship by a coupling plate and having the ability for being converted into holding at least two bins of lottery tickets and having display means for displaying the type of tickets contained therein.

SUMMARY OF THE INVENTION

The present invention is a side-by-side locking display and dispensing structure that is preferably utilized to serve as a point of sale device for lottery tickets and is formed of at least two dispensing units arranged in a side-by-side alignment and demountably attached together by a coupling plate located in between adjacent sidewalls of the dispensing units. The dispensing units are each formed of a box-like configuration having a floor, a roof, a pair of sidewalls, a front end and an open rear end, with each of the sidewalls having a rear edge with at least one coupling slot. A door is pivotally attached to the lower portion of the rear end of each dispensing unit and is semi-permanently attachable at an opposite upper portion of the dispensing unit rear end to serve as a rear wall for each unit when in a closed position.

The coupling plate has a plate-type body portion with generally flat side surfaces and a rear edge and a forward edge. Engagement means located at the rear edge of the body portion extend outwardly from the body portion sides for engaging the slots in the sidewalls of the dispensing units and the engagement means are adapted to coact with the dispensing unit doors to demountably lock the rear edge of the coupling plate to the sides of the dispensing units.

The sidewalls of the dispensing units have exterior surfaces each with a generally vertically aligned ledge portion. Correspondingly, the forward edge of the coupling plate includes lug portions for engaging the sidewall ledge portions to demountably attach the forward edge of the coupling plate to the dispensing units.

Additionally, the floor and roof of each of the dispensing units include interior surfaces having guide rails. Divider means are associated with the guide rails to separate the interiors of the dispensing units into at least two compartments.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may be employed in a variety of other embodiments and reference is made to the claims herein for interpreting the breadth of the invention.

DETAILED DESCRIPTION OF THE PREFERRED EMBODIMENT

Figure 1:
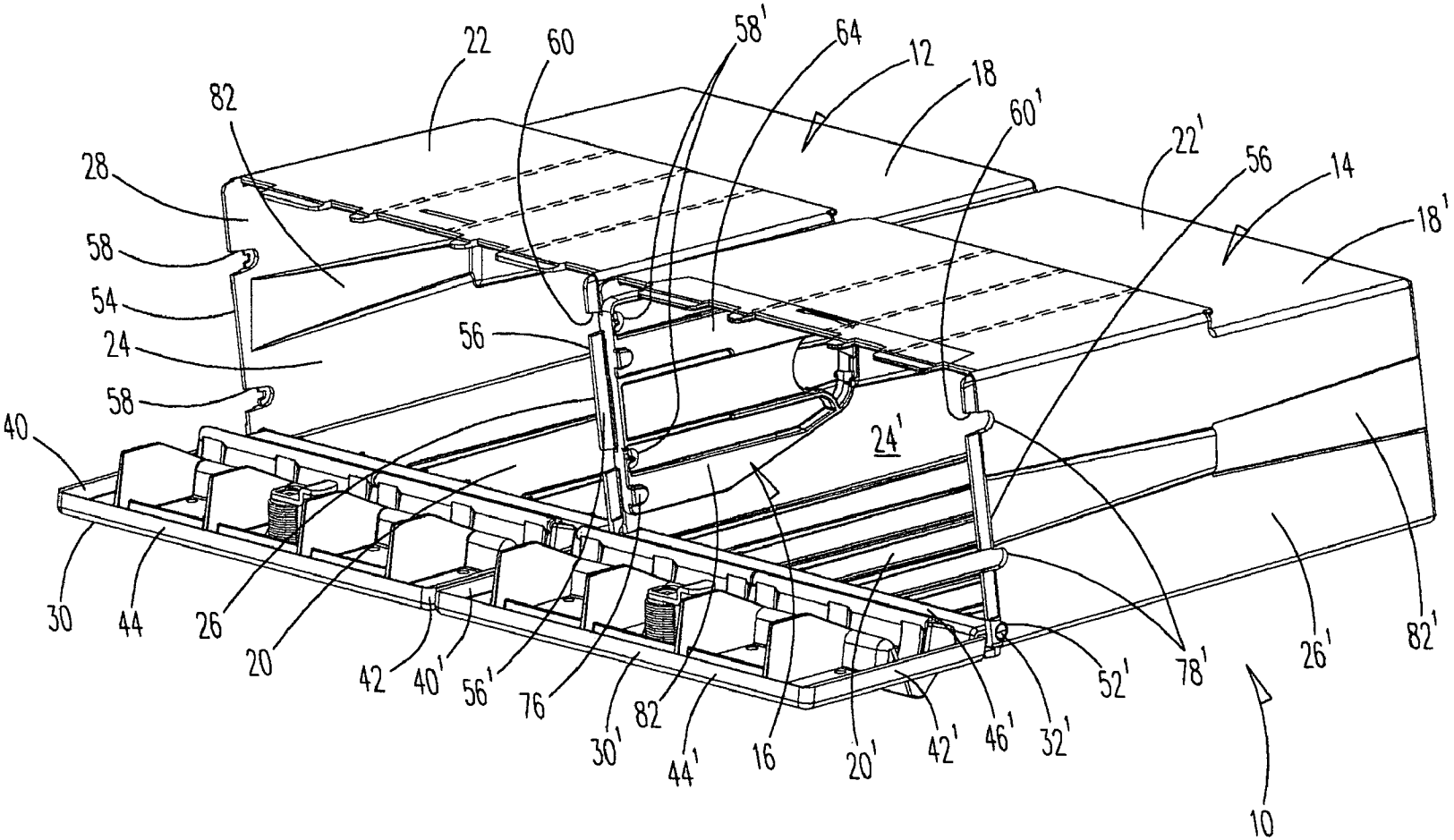
FIG. 1 is a side perspective view of a preferred embodiment of locking displaying and dispensing structure of the present invention including two dispensing units and a coupling plate for demountably connecting the dispensing units together and with the doors of the dispensing units shown in an open condition.
Figure 7:
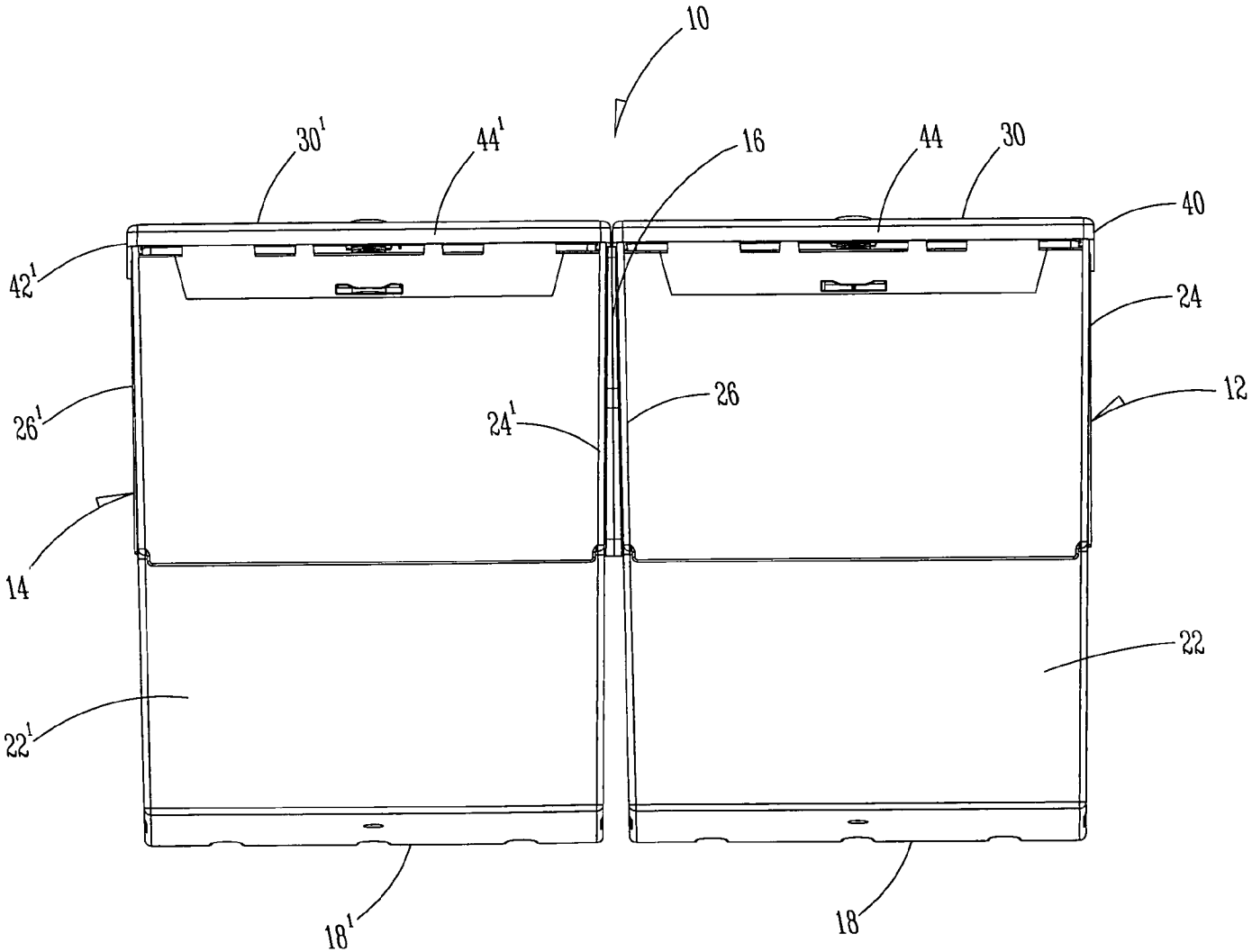
FIG. 7 is a plan view of the two dispensing structures of FIG. 1.

With reference now to the drawings, a preferred embodiment of a side-by-side locking display and dispensing structure of the present invention is shown in FIGS. 1 and 7, indicated generally at 10. As shown, the structure 10 is formed from two similarly constructed lottery ticket display and dispensing units 12 and 14 that are demountably attached together by a coupling plate 16, all of which are preferably injection molded. However, it should be understood by those skilled in the art that although only two dispensing units 12 and 14 are shown in FIGS. 1 and 7, through the use of a plurality of the coupling plates 16, the dispensing structure 10 could be formed with many more of the dispensing units 12 and 14.

The general construction of the dispensing units 12 and 14 is known in the art, but such construction has been improved in several ways to provide the present invention. One improvement is that prior dispensing units have previously not been provided with a means for connecting two or more units together in a locked side-by-side relationship. Accordingly, the present invention provides an advantageous means for providing such structure.

The construction of the units 12 and 14 is identical. Thus, only the components of the unit 12 are described in detail and similar components of the unit 14 are numbered the same except that the components of the dispenser 14 are primed.

The dispensing unit 12 is formed of a box-like configuration having a front end 18, a floor 20, a roof 22, opposite sidewalls 24 and 26 and an open rear end 28 that allows access to the inside of the unit 12. The sidewalls 24 and 26 have a slight draft from rear to front for convenience of removal of the unit 12 from the mold in which it is formed as is well-known in the art.

Figure 2:
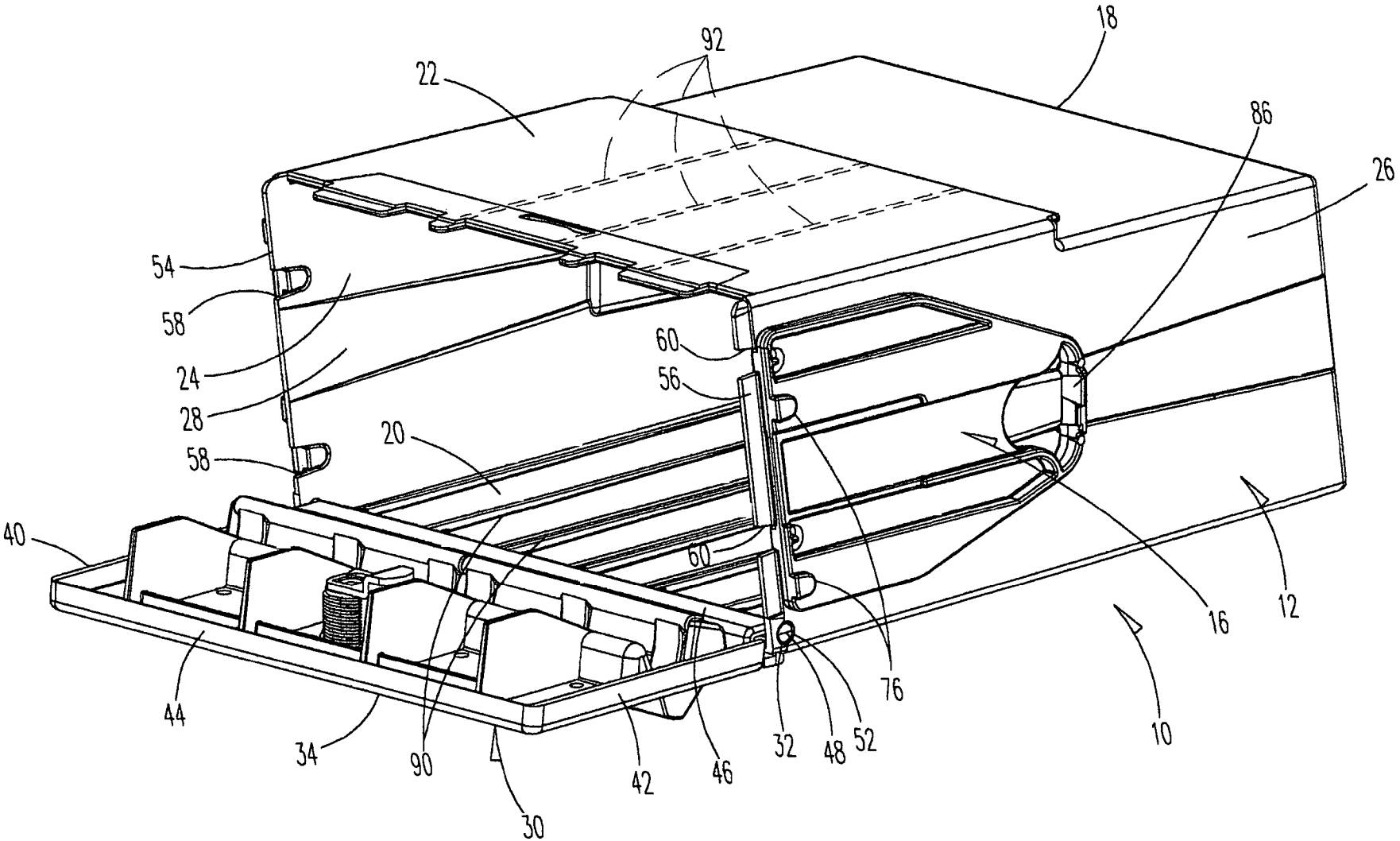
FIG. 2 is a side perspective view of one of the dispensing units and the coupling plate shown in FIG. 1.
Figure 11:
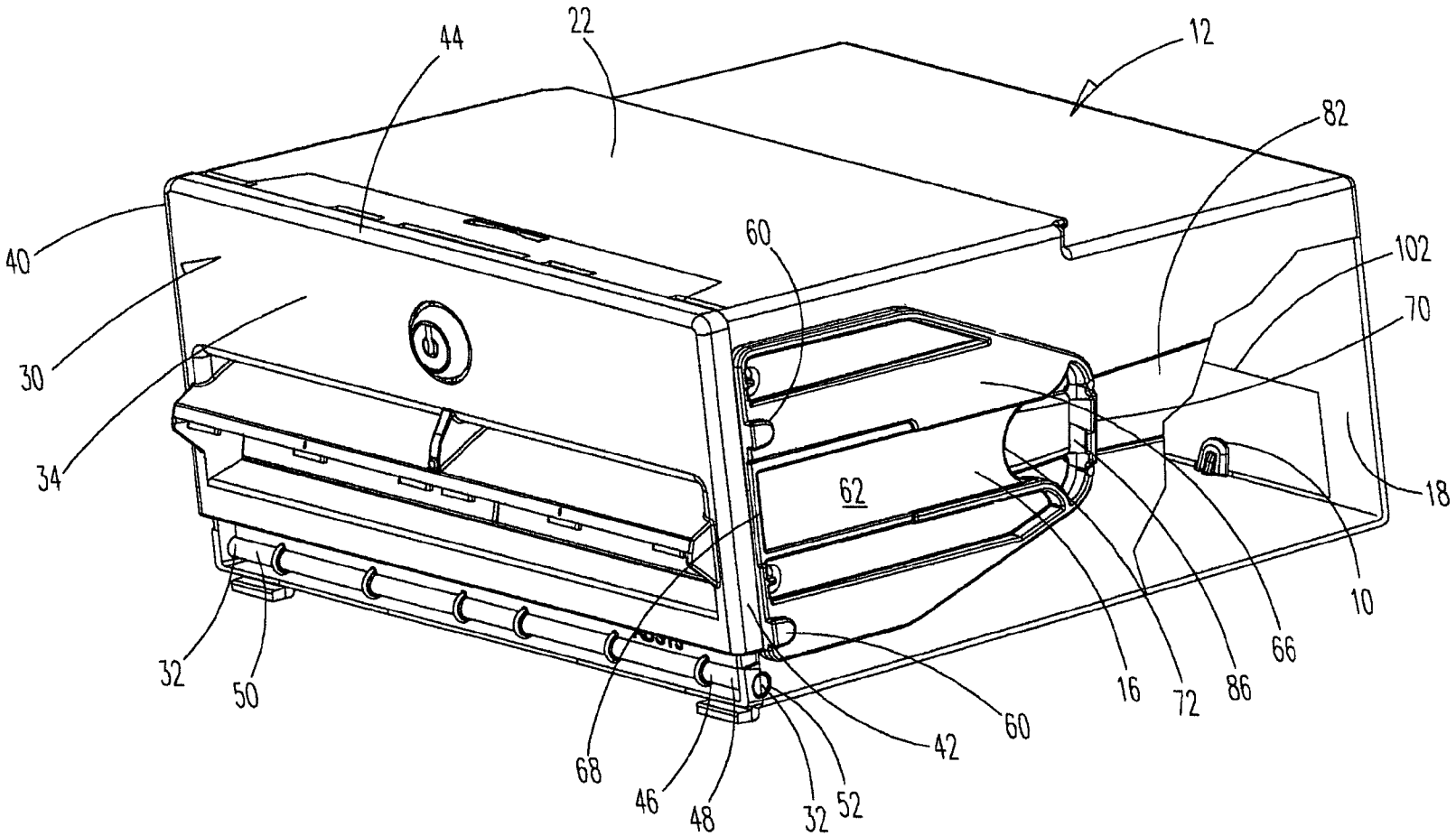
FIG. 11 is a side view perspective similar to that of FIG. 2, but with the door in a closed condition and with a rear portion broken away to more clearly show a lottery ticket displayed in the dispenser and held in position by a ticket retainer.

The unit 12 further includes a door 30 that is pivotally attached to the bottom portion of the sidewalls 24 and 26 at 32, as best shown in FIGS. 2 and 11, and is thereby movable from an open condition, shown in FIG. 2, to a closed condition, shown in FIG. 11, to close off the open rear end 28 of the unit 12. As further shown in FIGS. 2 and 11, the door 30 has a generally vertical exterior face 34 that terminates on the sides and top by vertical side flanges 40 and 42 and a horizontal top flange 44 respectively.

To provide the pivot attachment 32 for the door 30, a bottom portion 46 of the door 30 is generally cylindrical in shape and has a pair of cylindrical posts 48 and 50 at opposite ends. The posts 48 and 50 are designed to be receivably journaled in circular openings 52 in the sidewalls 24 and 26 to pivotally attach the bottom portion 46 to said sidewalls.

The dispensing units 12 and 14 are preferably entirely molded of a clear high strength plastic material such as polycarbonate. Such material has inherent flexible and resilient qualities. Because of such flexible and resilient qualities, the door 30 is semi-permanently attachable to the sidewalls 24 and 26 as described above. The unit sidewalls 24 and 26 have respectively rear edges 54 and 56 that respectively have spaced apart, short coupling slots 58 and 60 for a purpose to be described below.

Although the configuration of the slots 58 and 60 is identical, the slots 58 are preferably formed in locations of the rear edge 54 that are further removed from the roof 22 than are the locations of the slots 60 in the rear edge 56, also for a purpose to be described below. The width of the door 30 is slightly larger than the distance between the sidewalls 24 and 26 so that when the door 30 is closed, the side flanges 40 and 42 overlie the rear edges 54 and 56 of the sidewalls and the openings of the slots 58 and 60.

Figure 3A:
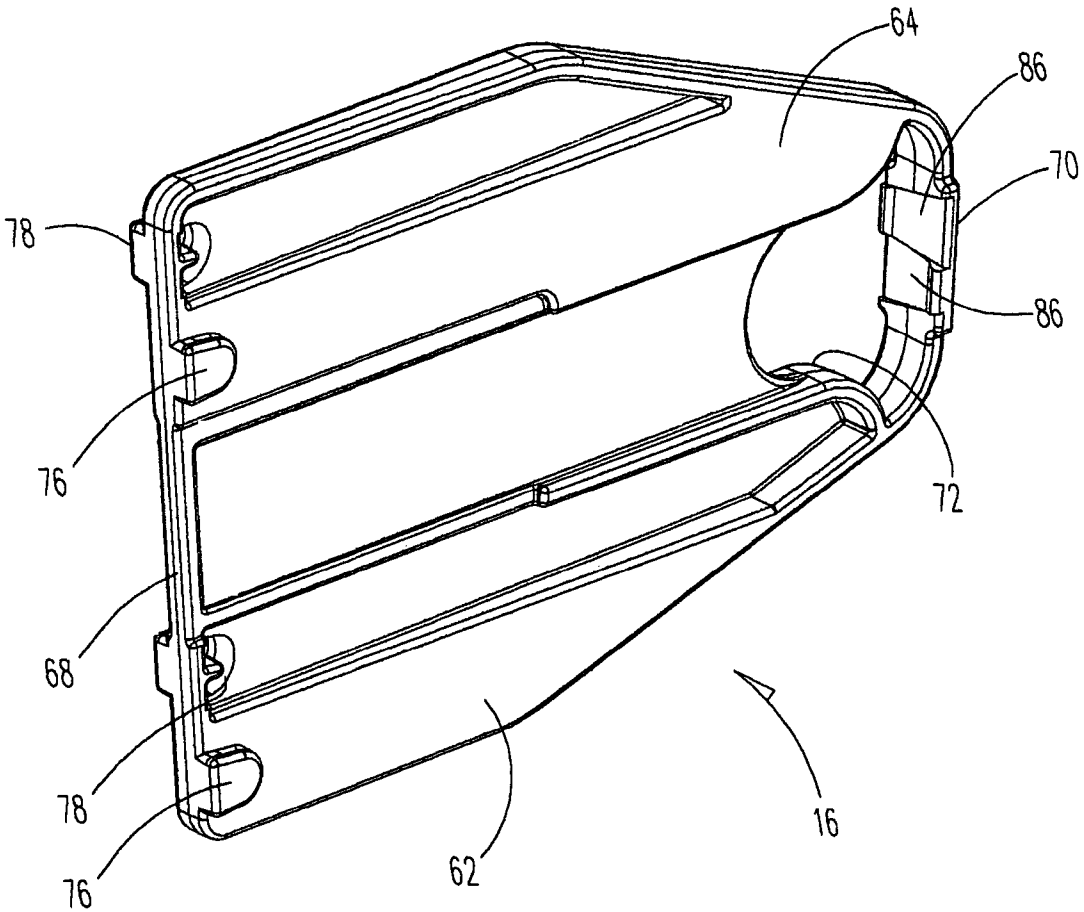
FIG. 3*a* is a perspective view of one of the sides of the coupling plate of FIG. 1.
Figure 3B:
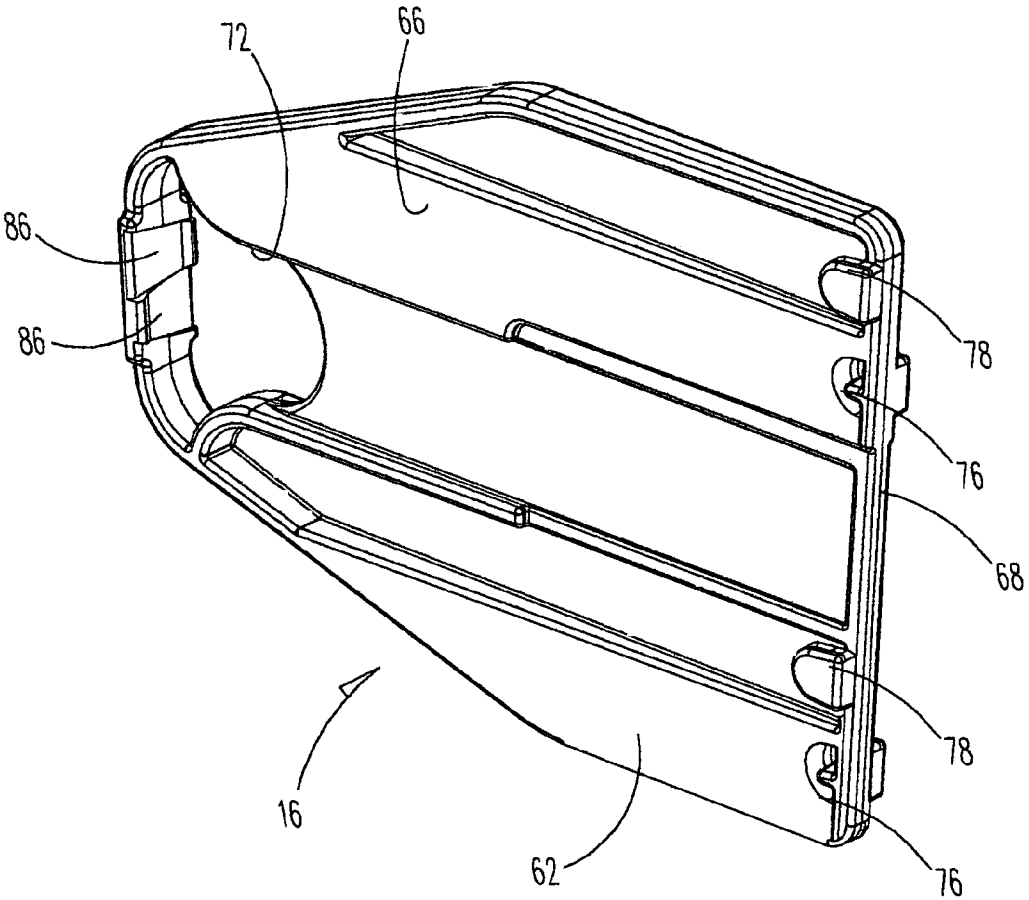
FIG. 3*b* is a perspective view of the other side of said coupling plate.
Figure 4:
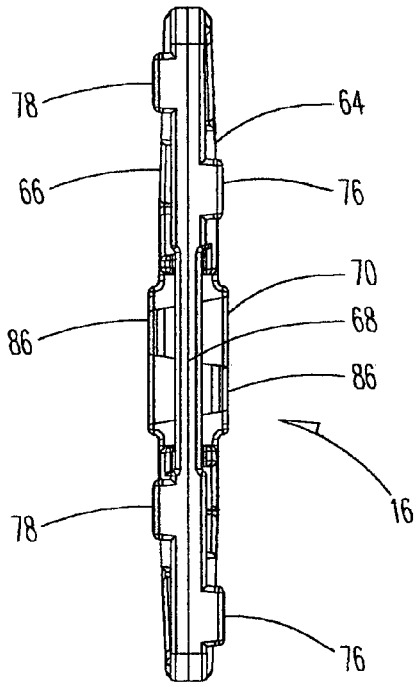
FIG. 4 is a rear end view in elevation of the coupling plate of FIG. 1.

To provide a demountable locking connection between the units 12 and 14, the coupling plate 16 is employed. Referring to FIGS. 3*a*, 3*b* and 11, the coupling plate 16 is formed with a plate-type body 62 having generally flat surfaces 64 and 66 a rear edge 68 and a forward edge 70. As indicated best in FIG. 7, the body 62 has a slight draft from front to rear to compensate for the draft of the units 12 and 14. Also, the plate 16 is formed of a solid piece of material except for an aperture 72 located near the forward edge 70. Also, the body has recessed portions to form strengthening ribs as is known in the art.

Referring now to FIGS. 3*a*, 3*b*, 4-6 and 11, preferably, a first pair of spaced apart, hook shaped engagement means 76 protrude outwardly from the body surface 64 near the rear edge 68. A second pair of engagement means 78 similarly shaped to the means 76 protrude outwardly from the body side 66, also near the rear edge 68, but are offset from the position of the engagement means 76 so that the means 78 are located closer to the top of the plate 16.

As indicated in FIG. 2, the engagement means 78 are sized to fit into the slots 60 of the sidewall 26 of the unit 12 to demountably lock the rear edge 54 of the plate 16 to the sidewall 26. Similarly, as indicated in FIG. 1, the engagement means 76 fit into the slots $\mathbf{58}^1$ of the sidewall $\mathbf{24}^1$ of the unit 14 to secure the rear edge 54 to the unit 14 thereby interconnecting the dispensing units 12 and 14 together. This interconnection must be made while the doors 30 and $\mathbf{30}^1$ of the dispensing units 12 and 14 are open so that the engagement means 76 and 78 can be positioned into the slots $\mathbf{58}^1$ and 60. However, once this interconnection is made the doors 30 and $\mathbf{30}^1$ can then be closed to secure the engagement means 76 and 78 in the slots $\mathbf{58}^1$ and 60, with the side flanges $\mathbf{40}^1$ and 42 of the doors $\mathbf{30}^1$ and 30 overlying the open end of the slots $\mathbf{58}^1$ and 60, as best indicated in FIG. 11.

Figure 8:
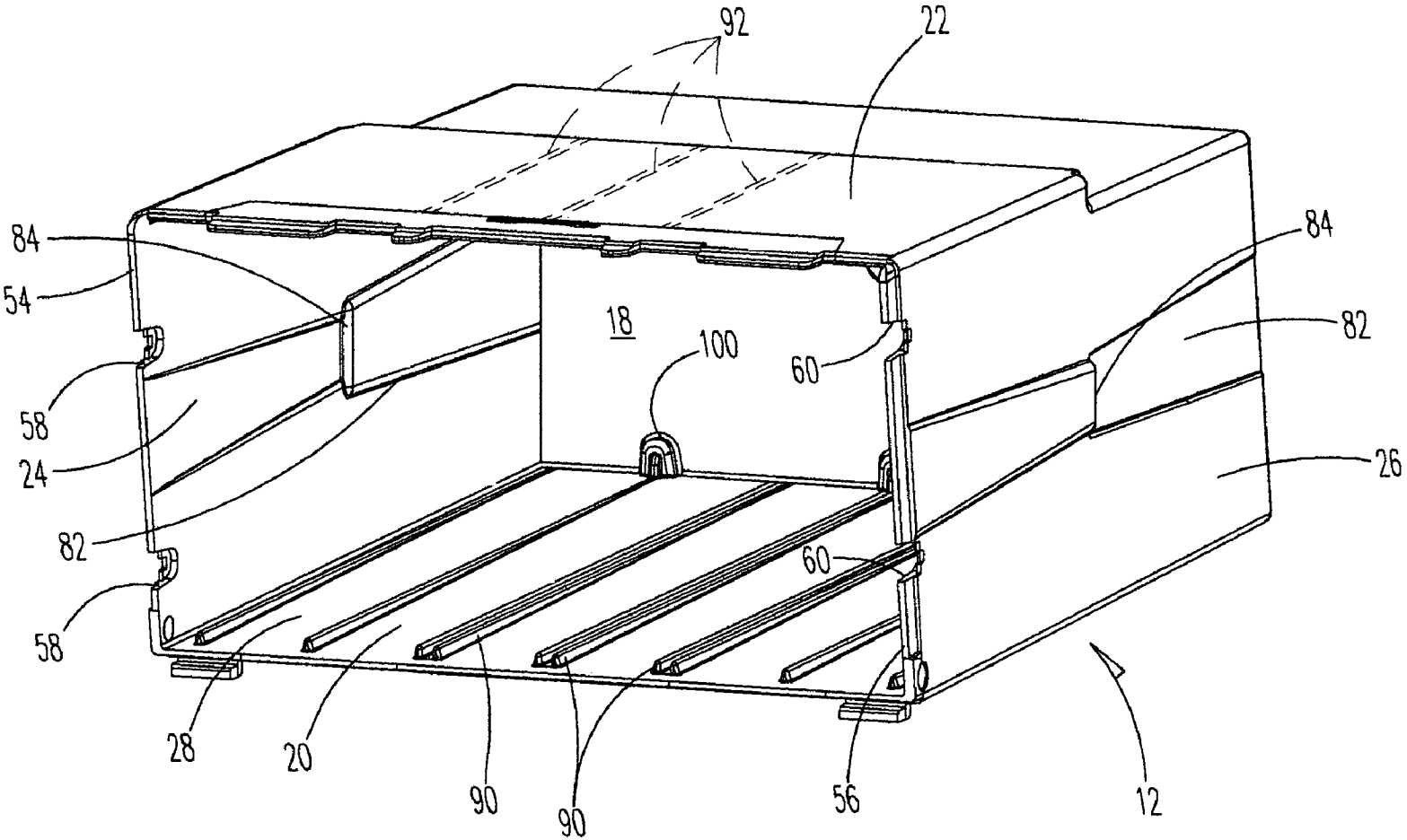
FIG. 8 is a side perspective view of one of the dispensing units shown in FIG. 1, but with the rear door removed to better show the configuration of guide rails on the floor of the dispensing unit.

To insure a more complete connection between the dispensing units 12 and 14, the sidewalls 24, $\mathbf{24}^1$ and 26, $\mathbf{26}^1$ each include a recessed channel 82, $\mathbf{82}^1$ that is aligned generally horizontally in the front half of said sidewalls 24, $\mathbf{24}^1$ and 26, $\mathbf{26}^1$, as most clearly indicated in FIGS. 8 and 11. The recessed channels 82, $\mathbf{82}^1$ terminate at approximately the horizontal midpoint of the sidewalls 24, $\mathbf{24}^1$ and 26, $\mathbf{26}^1$ to form ledges 84, $\mathbf{84}^1$ respectively that are generally in a vertical alignment to coact with the ledges 84, $\mathbf{84}^1$. The coupling plate 16 is formed with lug portions 86 on its forward edge 70.

Figure 5:
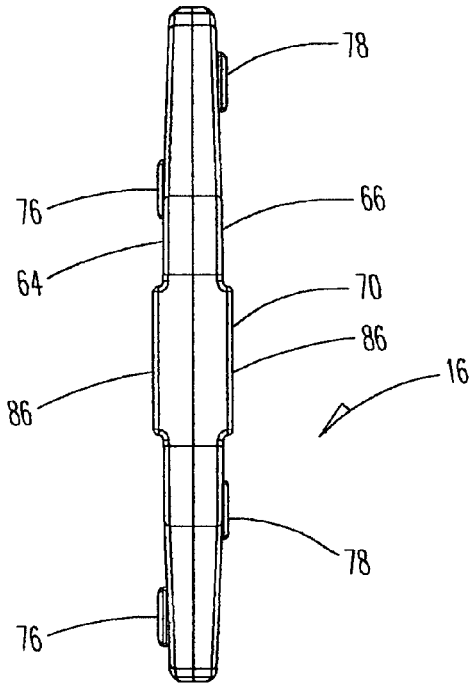
FIG. 5 is a front view in elevation of the coupling plate of FIG. 1.
Figure 6:
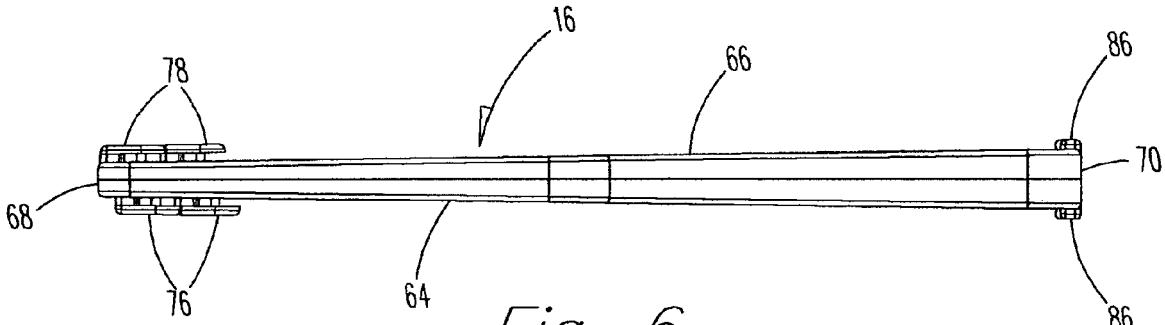
FIG. 6 is a plan view of the coupling plate of FIG. 1.

As shown most clearly in FIGS. 5 and 6, the lug portions 86 extend outwardly from both sides of the plate 16 a small amount to form essentially nodes on either side of the front end of the plate 16. When the dispensing units 12 and 14 are connected to the plate 16, the lug portions 86 engage the ledges 84, $\mathbf{84}^1$ to demountably lock the forward edge 70 of the plate 16 to the sidewalls $\mathbf{24}^1$ and 26. The dimensions of the coupling plate 16 are such that the lug portions 86 snuggly engage the ledges 84, $\mathbf{84}^1$ to securely fasten the coupling plate 16 to the units 12 and 14 and form the locking display and dispensing structure 10.

Thus, the use of the coupling plate 16 provides a convenient and relatively inexpensive method for attaching at least two display and dispensing units 14 and 16 together in a side-by-side relationship. By the use of additional coupling plates 16, a horizontal row of a plurality of dispensing units can be securely fastened together.

Figure 13:
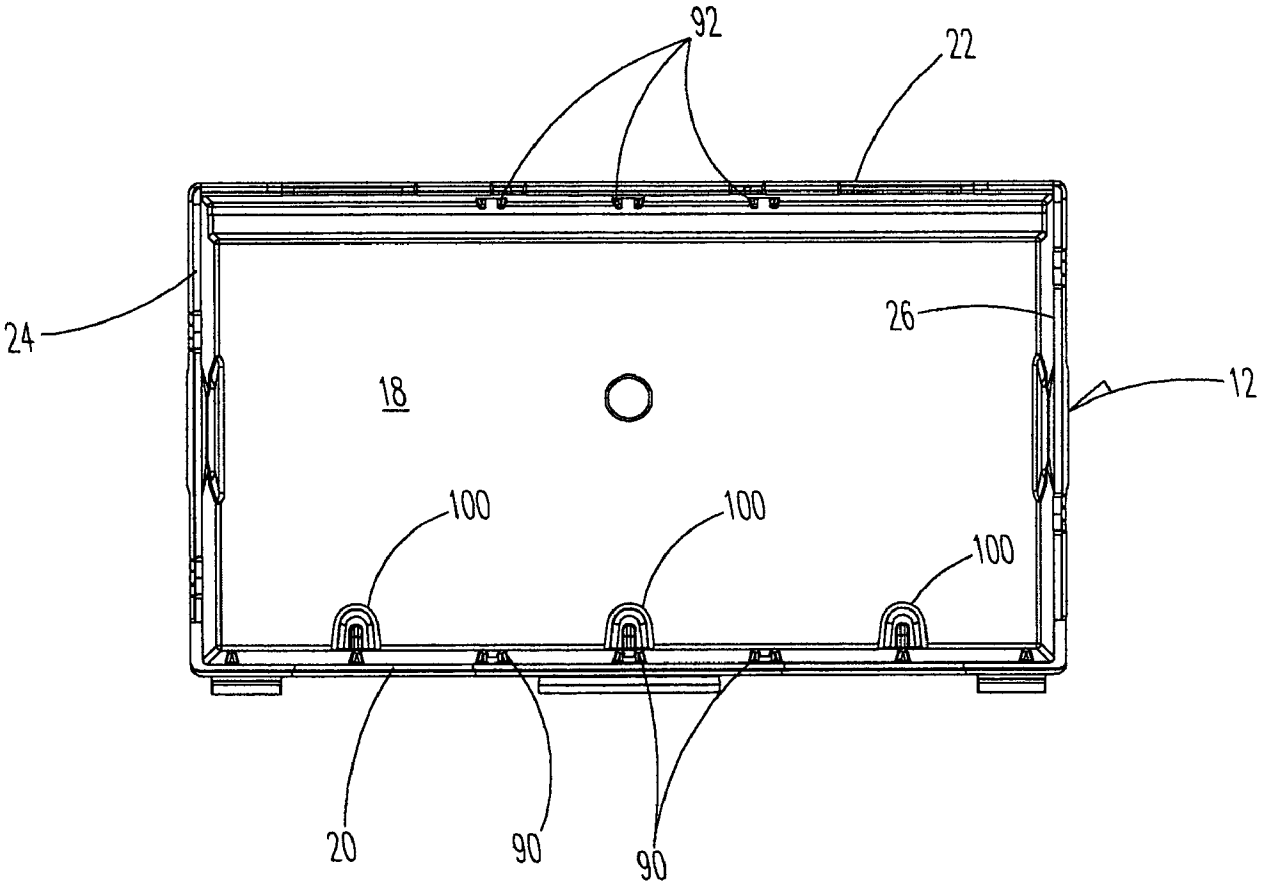
FIG. 13 is a rear view similar to that of FIG. 12, but without the divider and lottery ticket shown therein.

In addition to the advantage of being lockable together, the dispensing units 12 and 14 also are designed to be adaptable to provide a variable width of compartments or bins within their interiors to conform to different sizes of lottery tickets. Such feature is provided through the use of three spaced apart guide rails 90 on the interior surface of the floor 20 and three similar type guide rails 92 on the interior surface of the roof 22 directly over the guide rails 90 and in alignment therewith, as indicated in FIGS. 8 and 13. The guide rails 90 extend from the rear end of the floor 20 to the front end 18 and the guide rails 92 extend along the rear half of the roof 22.

Figure 9:
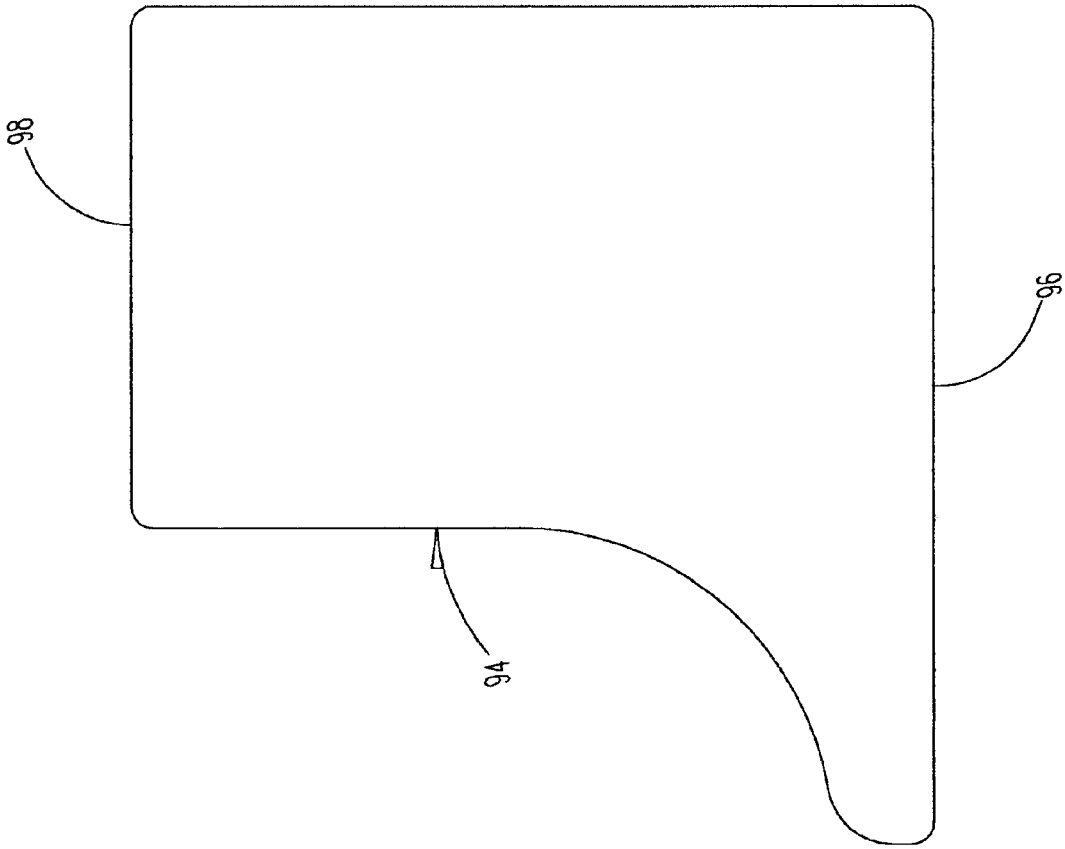
FIG. 9 is a side view in elevation of a divider designed to be utilized with one of the dispensing structures of FIG. 1.
Figure 10:
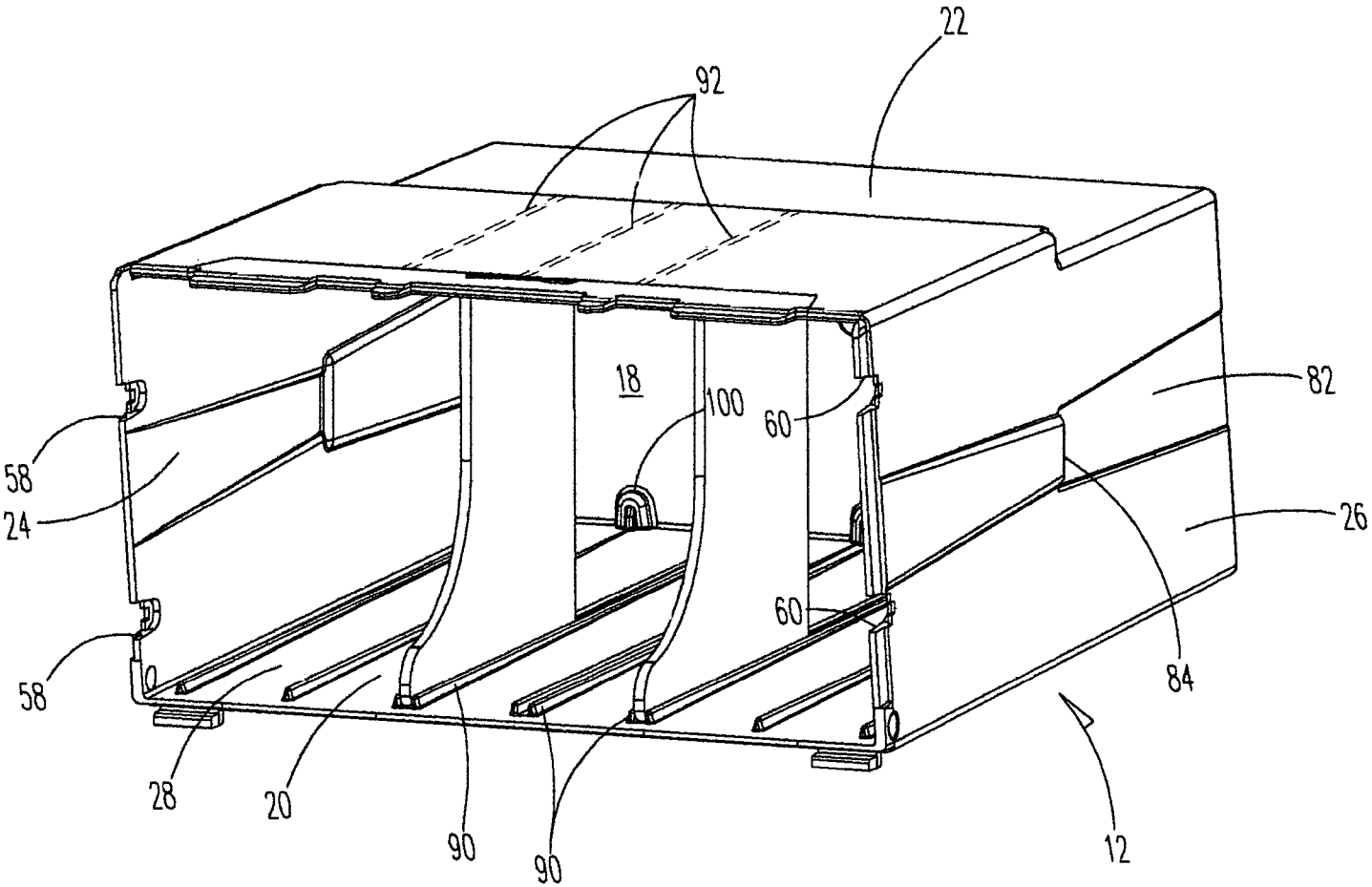
FIG. 10 is a side perspective view similar to that of FIG. 8, but showing two of the dividers of FIG. 9 located within the dispensing unit to divide the interior of the unit into three compartments.
Figure 12:
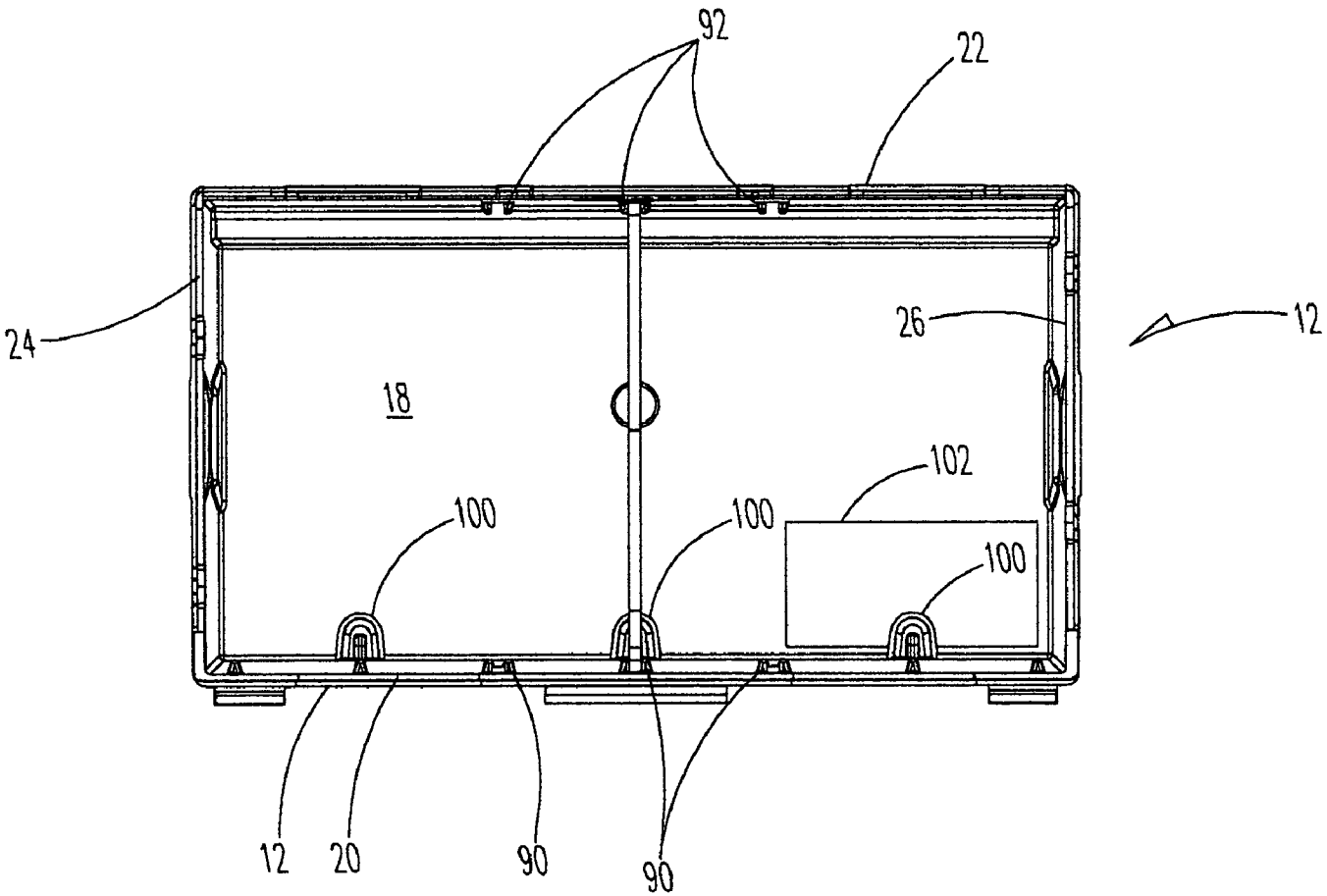
FIG. 12 is a rear view in elevation of one of the dispensers of FIG. 1 with the door removed and with one divider included to separate the interior of the dispenser into two compartments and also illustrating the location of three lottery ticket retainers within the unit, with one of the retainers holding a lottery ticket for display.

The guide rails 90 and 92 are each adapted to receive a divider panel 94 as shown in FIGS. 10 and 12. Each divider panel 94 as shown in FIGS. 9 and 10 is formed of a thin partition type configuration with a bottom 96 and a top 98 sized to fit into the guide rails 90 and 92. Thus, depending upon the number of divider panels 94 utilized, the dispensing unit 14 can be divided into two lottery ticket compartments as indicated in FIG. 12 or into three compartments as indicated in FIG. 10. Accordingly, simply by rearranging the position and number of the divider panels 94 in the dispensing unit 14, the number of lottery ticket compartments therein can be varied.

Another feature of the present invention is the ability of the dispensing units 12 and 14 to be able to display through the front face 18, 18[1] a sample of the lottery tickets for the particular lottery games that are stored therein. This ability of the present invention is provided by the use of three tickets fasteners 100 as best shown in FIGS. 12 and 13. The fasteners 100 extend upwardly from the floor 20 of the dispensing unit 12 and are closely positioned to the front face 18 so as to be able to each securely hold a lottery ticket 102 in position so that a perspective customer can easily view the ticket through the front end 18 of the unit 12, as indicated in FIG. 11. Thus, the ticket fasteners 100 provide a simple and efficient means for providing a point of sale lottery ticket display for the various lottery games included in the dispensing unit 12.

It can, thus, be readily seen that the present invention provides a simple and efficient means for serving as a releasable, but locked connecting means between a pair of lottery ticket display and dispensing units in a side-by-side relationship. Although the invention has been described with respect to a preferred embodiment thereof, it is to be understood that the invention is not to be so limited since changes and modifications can be made therein which are within the full intended scope of this invention as defined by the appended claims.

What is claimed is:

1. A side-by-side locking display and dispensing structure comprising:

(a) a first dispensing unit of box-like configuration having a floor, a roof, a pair of sidewalls, a front end and an open rear end, said sidewalls each having a rear edge with at least two spaced apart coupling slots;

(b) a first dispensing unit door pivotally attached to the lower portion of the rear end of said first unit and semi-permanently attachable at an opposite upper portion of the rear end of said unit to serve as a rear wall for said unit when in a closed position;

(c) a second dispensing unit of box-like configuration having a floor, a roof, a pair of sidewalls, a front end and an open rear end, each of said sidewalls having a rear edge with at least two spaced apart coupling slots;

(d) a second dispensing unit door pivotally attached at the lower portion of the rear edge of said second unit and semi-permanently attachable at an opposite upper portion of the rear edge of said second unit to serve as a rear wall for said unit when in a closed position;

(e) a coupling plate for demountably attaching said first dispensing unit in association with said second dispensing unit in a side-by-side relationship whereby one of the sidewalls of said first dispensing unit is adjacent to one of the sidewalls of said second dispensing unit and said coupling plate being located in between said adjacent sidewalls and including:

(1) a plate-type body portion having generally flat side surfaces and a rear edge and a forward edge;

(2) at least two spaced apart first engagement means located solely near the rear edge of said body portion and extending outwardly from one generally flat side surface of said body portion for engaging said at least two slots in the adjacent sidewall of said first dispensing unit;

(3) at least two spaced apart second engagement means located solely near the rear edge of said body portion and extended outwardly from the opposite generally flat side surface of said body portion for engaging said at least two slots in the adjacent sidewall of the second dispensing unit; and (4) said first and second engagement means are adapted to coact with said first and second doors on said first and second dispensing units to demountably lock said rear edge of said plate to the adjacent sides of said dispensing units when said first and second doors are in a closed condition.

2. The locking display and dispensing structure as described in claim 1 and further comprising:

(a) each of said sidewalls of said first dispensing unit having an exterior surface with a generally medially disposed, vertically aligned ledge portion;

(b) each of said sidewalls of said second dispensing unit having an exterior surface with a generally medially disposed, vertically aligned ledge portion; and (c) said coupling plate further include lug portions spaced apart from said first and second engagement means and extending outwardly from the side surfaces of said body portion at the forward edge of said body portion for engaging the ledge portions of said adjacent sidewalls of said first and second dispensing units to demountably attach said forward edge to said units.

3. The locking display and dispensing structure as described in claim 1, wherein each of said sidewalls of said first and second dispensing units include a plurality of said coupling slots and said coupling plate includes a plurality of said first and second engagement means that are each hook shaped to engage said coupling slots.

4. The locking display and dispensing structure as described in claim 2, wherein said sidewall ledge portions are generally medially located between said front and rear ends of each of said dispensing units.

5. The locking display and dispensing structure described in claim 1, wherein said structure comprises more than two dispensing units and more than one of said coupling plates.

6. The locking display and dispensing structure as described in claim 1, wherein the floor and roof of each of said first and second dispensing units include interior surfaces having guide rails and said structure further includes divider means associated with said rails to separate the interiors of said dispensing units into at least two compartments.

7. The locking display and dispensing structure as described in claim 6, wherein said structure includes at least two guide rails on each of the floor and roof of said first and second dispensing units.

8. The locking display and dispensing structure as described in claim 7, wherein said structure further includes two divider means associated with said guide rails to separate the interiors of said dispensing units into at least three compartments.

9. The locking display and dispensing structure as described in claim 1, wherein said dispensing units are adapted to dispense a variety of lottery tickets associated with particular types of lottery games and said dispensing units further include ticket fasteners proximate to the front ends of said dispensing units for displaying at least one of said tickets for said games located in said units.

10. The locking display and dispensing structure as described in claim 9, wherein said displayed tickets can be seen through the front ends of said dispensing units.

* * * * *